United States Patent [19]

Simon et al.

[11] Patent Number: 4,493,261

[45] Date of Patent: Jan. 15, 1985

[54] REINFORCED EXPLOSIVE SHOCK TUBE

[75] Inventors: James R. Simon, Lachute; David J. Welburn, Brownsburg, both of Canada

[73] Assignee: CXA Ltd./CXA LTEE, North York, Canada

[21] Appl. No.: 547,861

[22] Filed: Nov. 2, 1983

[51] Int. Cl.[3] ..... F42D 3/00

[52] U.S. Cl. ..... 102/331; 102/275.8; 102/275.11

[58] Field of Search ..... 102/321, 331, 275.8, 102/275.11

[56] References Cited

U.S. PATENT DOCUMENTS

| | | | |
|---|---|---|---|
| 2,969,101 | 1/1961 | White | 102/331 X |
| 3,908,549 | 9/1975 | Turner | 102/275.8 X |
| 4,205,611 | 6/1980 | Slawinski | 102/331 X |
| 4,232,606 | 11/1980 | Yunan | 102/275.8 |
| 4,328,753 | 5/1982 | Kristensen et al. | 102/275.5 |
| 4,369,711 | 1/1983 | Leader | 102/331 X |

FOREIGN PATENT DOCUMENTS

| | | | |
|---|---|---|---|
| 562263 | 8/1958 | Canada | 102/331 |

*Primary Examiner*—Peter A. Nelson

*Attorney, Agent, or Firm*—Donald G. Ballantyne

[57] ABSTRACT

Low energy explosive shock tubing is provided which consists of a two-ply, inner and outer layer plastic tube having a plurality of lengthwise textile filaments bonded into the interface between the plastic layers. The textile filaments are chosen for their low elongation properties and the resultant shock tube resists stretching especially in warm borehole environments.

6 Claims, 2 Drawing Figures

REINFORCED EXPLOSIVE SHOCK TUBE

The present invention relates to low energy explosive shock tubing of the NONEL (Reg. TM) type. In particular, the invention relates to an explosive shock tube having improved resistance to stretch and break especially in a hot borehole environment.

Explosive shock tubing as disclosed in Canadian Pat. No. 878,056 granted Aug. 10, 1971 is now widely known and used in the blasting art. This shock tubing or detonating fuse consists of small diameter, for example, 5 millimeters outside diameter tubing of a pliable plastic, such as polyvinyl chloride, polyethylene, SURLYN (Reg. TM) or the like having an inner diameter of about 3 millimeters. The inner walls of the tubing has adhered thereto a thin layer of powdered explosive or reactive material, such as PETN (pentaerythritol tetranitrate), HMX (cyclotetramethylenetetranitramine) or powdered metal mixtures with these. When initiated at one end by means of an appropriate device such as a detonating cap, a percussion or impact wave is propagated within and along the tubing to activate a blasting cap attached at the remote end of the tubing. Explosive shock tubing may be employed in most instances as a replacement for conventional detonating cord in non-electric blasting and has the advantage of low noise, safe handling and low cost.

A modified type of low energy explosive shock tube, having a sandwich-type construction of two different plastic materials, is disclosed in Canadian Pat. No. 1,149,229 granted July 5, 1983. This type of tubing is designed to withstand mechanical stress.

Both the single ply and double ply (sandwich) plastic shock tubing is susceptible to elongation and possible breakage particularly when used in boreholes containing warm or hot explosives, for example, water-gel or slurry compositions. Elongation can also occur in surface blasting operations, quarrying and the like where the tubing is stressed after exposure to the sun's heat particularly in tropical climates. Elongation has the effect of thinning out or dislodging the film of reactive material coated on the inner tube surface which action may lead to the malfunctioning of the shock tube as an energy conveyor. In particular, where a booster charge attached to a length of shock tubing is suspended in borehole filled with a hot (65° C.) explosive mixture, stretching of the tubing inevitably occurs and, occasionally, the tube is stretched to the breaking point.

It has now been found that stretching of explosive shock tubing can be eliminated by providing a tube consisting of a sandwich-type construction comprising inner and outer tube layers, the inner layer having high adhesion properties for a thin layer of powdered energy-producing material distributed on its inner surface and the outer layer having high resistance to mechanical damage, and a plurality of lengthwise textile filaments of low elongation properties bonded at the interface of the inner and outer tube layers.

The accompanying drawing, in which

Figure 1:
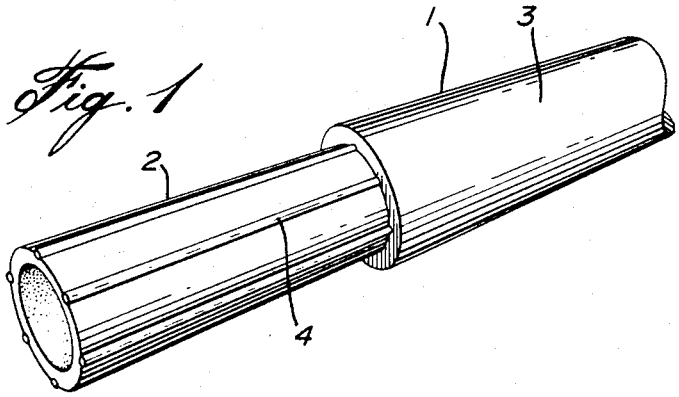
Figure 2:
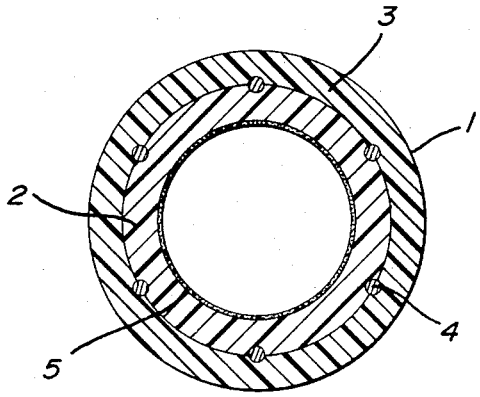

FIG. 1 is a perspective view of the end portion of a reinforced shock tube; and FIG. 2 is a cross-section of the tube of FIG. 1 will provide a fuller understanding of the invention.

With reference to the drawing where like numerals are used for like parts, there is shown a two-ply plastic tube 1 consisting of an inner tube ply 2 and an outer tube ply 3. At the interface between plies 2 and 3 and bonded thereto are lengthwise textile filaments 4. Coated on the inner walls of ply 2 is a powdered energy generating material 5. The plastic comprising inner tube ply 2 is one which has good adhesion properties for the powdered energy generating material 5. SURLYN (Reg. TM), a salt-containing polyethylene ionomer, has been found to be particularly suitable. The plastic of the outer tube ply 3 is chosen for its resistance to mechanical damage and a polyethylene having a density of about 0.93 g/cm$^3$ is ideally suited for this purpose. Other suitable plastics for the outer tube are polypropylene, polyvinyl chloride, polyamide and polyurethane. The textile filaments 4 are selected from those filaments or cords which show substantially no elongation under longitudinal stress even at temperatures of the order of 65° C. Particularly useful are high tenacity, low elongation filaments made from viscose rayon, polyamide, polyester, polypropylene and polytetrafluoroethylene.

The number of textile filaments 4 employed will depend on the fineness or denier of the strand. From the point of view of convenience of manufacture and suitable bonding of filaments 4 to tube plies 2 and 3, filaments having a denier of between about 500 and 2000 are preferred. Typically between about 5 and 10 of such filaments are evenly distributed around and within the tubular sandwich.

The reinforced tubing of the invention is conveniently manufactured by an overextrusion process wherein the inner plastic tube ply 2 is extruded in a tube extrusion apparatus and the textile filaments are linearly applied or laid around the outer surface of the extruded tube. The filamented inner tube is then passed through a second extrusion apparatus where an overcoating of a second plastic is applied as tube ply 3. The filaments are, thus, enveloped between and bonded to tube plies 2 and 3.

EXAMPLE

A series of explosive shock tubes having various constructions were prepared and subjected to tensile strength tests at 22° C. and 65° C. The tests involved subjecting the shock tubes to stretch to the breaking point by the force of applied weight. The results are given in the Table below.

TABLE

| Tubing Type | Typical Construction | Typical Material Usage or Mass per Length (g/m) | Typical Dimensions (mm) OD | Typical Dimensions (mm) ID | Tensile Strength (kg) 22 C. | Tensile Strength (kg) 65 C. | Tensile Strength Reduction over Temperature Range 22 C. to 65 C. |
|---|---|---|---|---|---|---|---|
| Single tube | 100% SURLYN (Reg. TM) | 4.8 | 2.9 | 1.4 | 7.3 | 2.7 | 63% |
| Sandwich tube (unreinforced) | Inner ply: SURLYN | 4.8 | | | 10.0 | 3.2 | 68% |
| | Outer ply: Polyethylene | 2.7 | 3.8 | 1.4 | | | 68% |
| Textile Reinforced Tube I | Inner ply: SURLYN | 4.8 | | | 29.0 | 18.4 | 37% |
| | Textiles: 5 #1100 denier | 0.6 | 3.9 | 1.4 | | | |

TABLE-continued

| Tubing Type | Typical Construction | Typical Material Usage or Mass per Length (g/m) | Typical Dimensions (mm) OD | Typical Dimensions (mm) ID | Tensile Strength (kg) 22 C. | Tensile Strength (kg) 65 C. | Tensile Strength Reduction over Temperature Range 22 C. to 65 C. |
|---|---|---|---|---|---|---|---|
| | rayon | | | | | | |
| | Outer ply: Polyethylene | 2.7 | | | | | |
| Textile Reinforced Tube II | Inner ply: SURLYN | 4.8 | | | 38.5 | 29.9 | 22% |
| | Textiles: 10 #1100 denier rayon | 1.2 | 3.9 | 1.4 | | | |
| | Outer ply: Polyethylene | 2.7 | | | | | |

From the results in the Table, it can be seen that the fibre reinforced tubing showed a substantial improvement in tensile strength over the non-reinforced tubing.

The embodiments of the invention in which an exclusive property or privilege is claimed are defined as follows:

1. A low energy explosive shock tube comprising a bonded, two-ply, inner and outer layer plastic tube, the inner layer having high adhesion properties for a thin layer of powdered energy-producing material distributed on its inner surface and the outer layer having high resistance to mechanical damage and a plurality of lengthwise textile filaments of low elongation properties bonded at the interface of the said inner and outer tube layers.

2. An explosive shock tube as claimed in claim 1 wherein the said inner tube layer consists of a salt-containing polyethylene ionomer.

3. An explosive shock tube as claimed in claim 1 wherein the said outer tube layer plastic is selected from polyethylene, polypropylene, polyvinyl chloride, polyamide and polyurethane.

4. An explosive shock tube as claimed in claim 1 wherein the said textile filaments are selected from viscose rayon, polyamide, polyester and polytetrafluoroethylene.

5. An explosive shock tube as claimed in claim 1 wherein the denier of the said textile filaments is from 500 to 2000.

6. An explosive shock tube as claimed in claim 3 wherein the outer tube layer comprises polyethylene having a density of 0.93 g/cm$^3$.

* * * * *